US008733563B2

(12) United States Patent
Fadrowski

(10) Patent No.: US 8,733,563 B2
(45) Date of Patent: May 27, 2014

(54) DISPLAY UNIT WITH INTERCHANGEABLE SHELVING

(75) Inventor: Marian Fadrowski, Barrington, IL (US)

(73) Assignee: Continental Marketing, Inc., Chicago, IL (US)

( * ) Notice: Subject to any disclaimer, the term of this patent is extended or adjusted under 35 U.S.C. 154(b) by 368 days.

(21) Appl. No.: 13/169,527

(22) Filed: Jun. 27, 2011

(65) Prior Publication Data

US 2011/0315645 A1 Dec. 29, 2011

Related U.S. Application Data

(60) Provisional application No. 61/358,702, filed on Jun. 25, 2010.

(51) Int. Cl.
*A47F 5/02* (2006.01)

(52) U.S. Cl.
USPC ..... 211/144; 211/163

(58) Field of Classification Search
USPC ..... 211/78, 144, 163, 186, 196, 205
See application file for complete search history.

(56) References Cited

U.S. PATENT DOCUMENTS

| | | | | | |
|---|---|---|---|---|---|
| 3,123,220 | A * | 3/1964 | Hanson | 211/88.01 |
| 4,160,571 | A * | 7/1979 | Bigotti | 312/327 |
| 4,850,658 | A * | 7/1989 | Sandor | 312/225 |
| 5,022,539 | A * | 6/1991 | Rushing et al. | 211/132.1 |
| 5,118,176 | A * | 6/1992 | Motley, Sr. | 312/305 |
| 5,513,910 | A * | 5/1996 | Ellingwood et al. | 312/405.1 |
| 5,957,558 | A * | 9/1999 | Quade | 312/323 |
| 6,302,285 | B1 * | 10/2001 | Fulle | 211/189 |
| 6,837,467 | B2 * | 1/2005 | Cheng | 248/240 |
| 6,915,914 | B2 * | 7/2005 | Farrand | 211/163 |
| 7,954,655 | B2 * | 6/2011 | Virvo | 211/149 |
| D679,922 | S * | 4/2013 | Weigand | D6/675.2 |
| 2005/0145589 | A1 * | 7/2005 | Chen | 211/196 |

* cited by examiner

*Primary Examiner* — Jonathan Liu
*Assistant Examiner* — James Twomey
(74) *Attorney, Agent, or Firm* — Greer Burns & Crain, Ltd.

(57) ABSTRACT

One embodiment of the invention is a free standing display unit having a rotating base, at least one vertical support mounted on the base, and a plurality of shelves supported by the at least one vertical support. Each shelf is interchangeable between a plurality of different configurations, with a first configuration changeable to a second configuration by pivoting movement of one or more portions of the shelf between a stored position and an operational or display position.

12 Claims, 15 Drawing Sheets

DISPLAY UNIT WITH INTERCHANGEABLE SHELVING

PRIORITY CLAIM AND REFERENCE TO RELATED APPLICATION

This application claims priority under 35 U.S.C. §119 from prior provisional application Ser. No. 61/358,702, which was filed Jun. 25, 2010, and which is hereby incorporated by reference.

FIELD

An embodiment of the invention is directed to display units for displaying retail merchandise. Another embodiment is related to merchandise display units having interchangeable shelving and designed to promote and market a variety of merchandise having different sizes and shapes, including calendars, books, planners, souvenirs and various other 2- or 3-dimensional goods.

BACKGROUND

Retailers are generally limited in the products that can be displayed at any given time by the shelf space available to them. Products often require specialized fixtures to effectively and attractively display the product. Moreover, products are often seasonal, having an in-season period where the product is in high demand and an off-season period where demand for the same product is relatively low. Accordingly, purchase of special fixtures necessary to display such seasonal products is often expensive. Specialized fixtures are only useful for displaying a few products, and must be stored when not in use. Thus, not only does the need to use multiple display fixtures create cost, but it also requires storage space, reducing the amount of space the store can devote to the sales floor and/or inventory. Accordingly, it is important that retailers maximize the space available to them, and purchase fixtures that will be useful for displaying goods throughout the year, and not just in certain seasons.

SUMMARY

Embodiments of the invention include display units having shelves. One unique aspect of some invention embodiments includes interchangeable shelves. The shelves can be easily reconfigured to fit various marketing requirements and changing seasons: fall, winter, spring, summer. It is fully functional and useful throughout the year with a variety of different sized seasonal goods. One example display embodiment can merchandise calendars or other similarly sized goods (books, planners, generally flat profile merchandise having two dimensions much larger than a third and referenced herein as "two dimensional" or "2-D" for convenience, while understanding that such goods are actually of 3 dimensions) during the "in-season configuration", but can be easily reconfigured for differently sized off-season products, such as: 3-dimensional (3-D) merchandise with a larger foot print and requiring more horizontal shelf or display space than a calendar or other generally flat object in an "off-season configuration", or be reconfigured to a "peg-board configuration" to merchandise products that are designed to be hung off of peg-hooks. This embodiment therefore includes shelving that can be easily configured to store and display a variety of differently sized merchandise, including seasonal merchandise and general merchandise.

Furthermore, in this and many other embodiments all of the plurality of shelf configurations can be combined and implemented at the same time if desired. Having multiple different shelf configurations on one display allows a variety of different products to be displayed during each season and between seasons, and during the transition from one season to another. For example, in some embodiments an "in-season configuration" may be used to merchandise calendars, but since calendars are sold seasonally, the other configurations are used to merchandise other products having very different sizes for the rest of the year. Because each individual shelf can be configured separately, the display allows merchandising products between seasons. In other words, the various shelves of the display can be configured to show different types of products simultaneously e.g.: Calendars and other 2-D goods as well as bulkier 3-D products. This can be accomplished, for example, by configuring different sections of a display unit embodiment in different manners at the same time.

To accomplish this and other important advantages, one embodiment of the invention includes a free standing display unit having a rotating base, at least one vertical support mounted on the base, and a plurality of shelves supported by the at least one vertical support. Each shelf is interchangeable between a plurality of different configurations, with a first configuration changeable to a second configuration by a pivoting movement of one or more portions of the shelf between a stored position and an operational position.

In another embodiment of the invention, a display unit includes a rotating base, a vertical frame supported on the base, and a plurality of shelves vertically arranged on the frame. The shelves define sidewalls that form a perimeter about a central inner portion of the display, and each of the shelves is interchangeable between at least a first in-season configuration and a second off-season configuration. Moreover, each of the shelves includes a fence portion that is rotatable 270° about a vertical pivot between an operational position in the in-season position to hold an object on the shelf, and a storage position in the off-season configuration in the central inner portion. Each of the plurality of shelves has a first horizontal floor in the first in-season position and a second floor in the second off-season configuration, the second floor pivoting 90° about a horizontal axis between an operational position and a vertical storage position maintained in the in-season position.

DETAILED DESCRIPTION

Figure 1A:
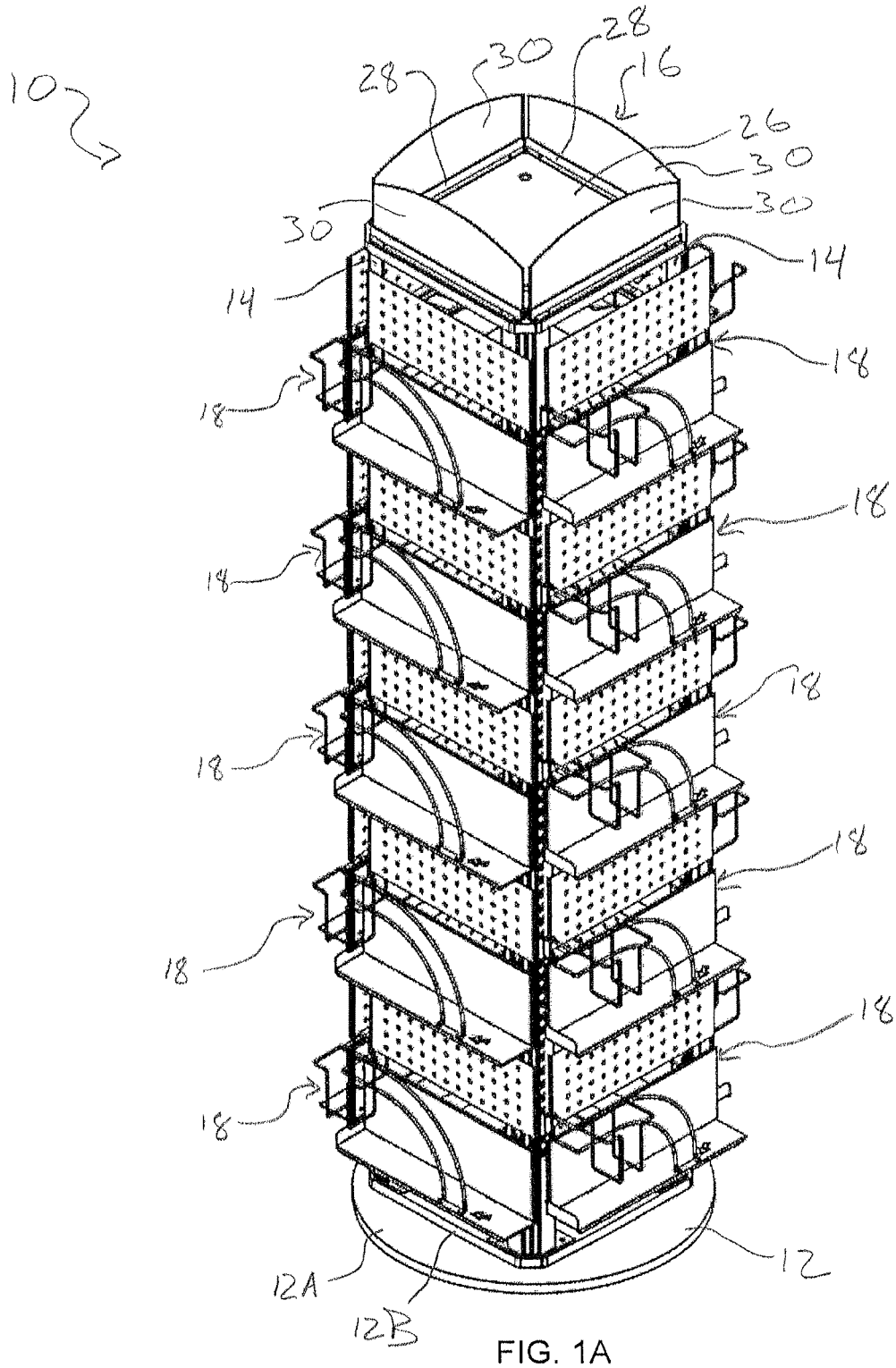
FIG. 1A is a top perspective view of a display unit according to an embodiment of the present invention, in a first "in-season" configuration.
Figure 1B:
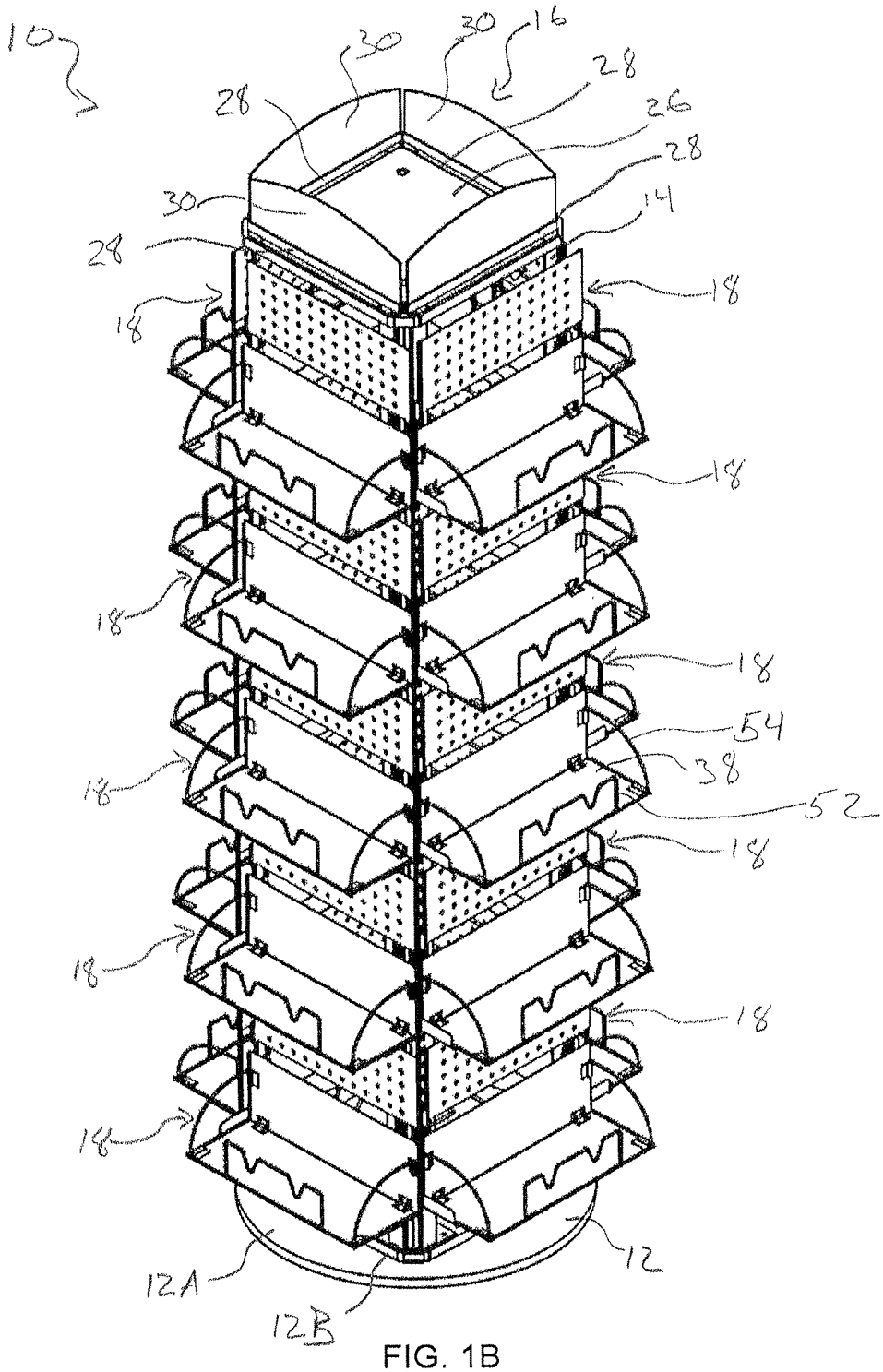
FIG. 1B is a top perspective view of the display unit, in a second "off-season" configuration.
Figure 1C:
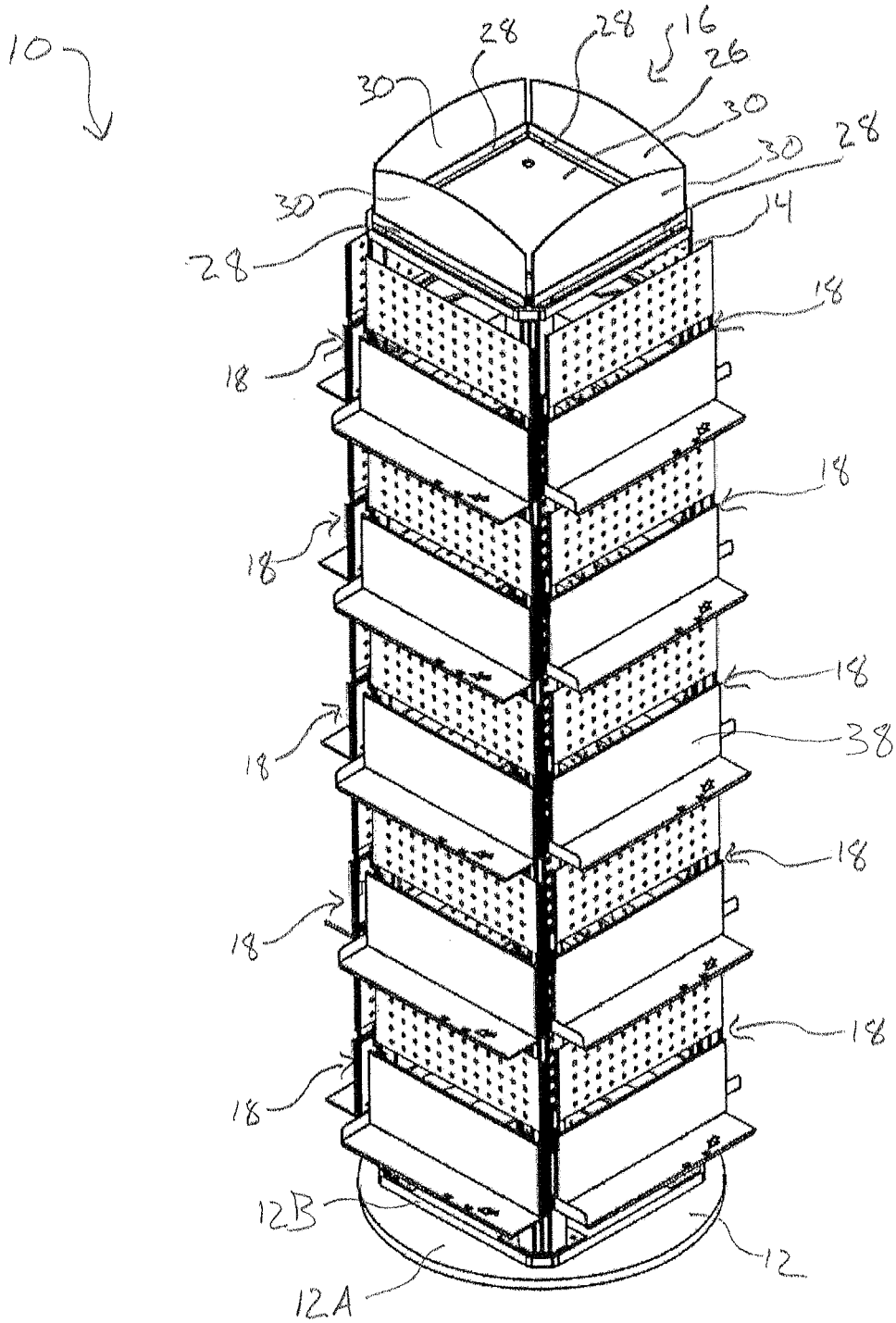
FIG. 1C is a top perspective view of the display unit, in a third "peg board" configuration.

Embodiments of the present invention are display units for displaying merchandise in, for example, a retail store. The display unit is configurable in a plurality of ways to allow for display of various types of merchandise as dictated by the season and/or other retail concerns. FIGS. 1A-1C illustrate an example display unit in three different display configurations. This represents an important aspect of the present invention—the ability to easily change shelf configuration between two or more display modes.

Referring now to FIG. 1A, an example display unit is generally designated 10. The display unit 10 includes a base 12, multiple supports 14, and a header 16 forming a frame 11 on which a plurality of shelf units 18 are mounted. In the embodiment illustrated, the header 16 is in the general shape of a square when viewed from above, with the supports 14 distributed about its respective four corners. As a result, the resulting frame and display unit 10 has a general shape of an upright, four-sided rectangular column with shelf units 18 vertically arranged thereupon.

The base 12 in some (but not all) embodiments allows for rotation of the display 10 about a center axis of the display 10. The example base includes a stationary circular portion 12A and a square mount 12B rotatably mounted thereon. The base square mount 12B is shaped in approximately the same dimensions as the header 16 with the supports 14 joining the two elements about their corners to at least partially define the frame 11. Rotation of the mount 12B can be achieved using any known configuration, such as ball bearings or roller bearings, bearing races, low friction pads, or other similar devices positioned between the mount 12B and the circular portion 12A, and rotatingly engaging both to allow relative rotation between the two pieces. Circular portion 12A and mount 12B may also have cooperating central axle and receiving cavity for rotatingly holding the two to one another.

Rotation may be manually driven by a user, or an electric or other motor may be provided with corresponding drive gearing for driving rotation. Additionally, the base portion 12B is designed to be stable and durable to help avoid tipping and maintain sustained spinning, even when the display is fully loaded with merchandise. For this purpose, the base may be weighted, and/or may be configured for mounting attachment to an underlying floor. The base 12 may be made from any suitably durable material, such as wood, steel, plastic, or the like.

Figure 2:
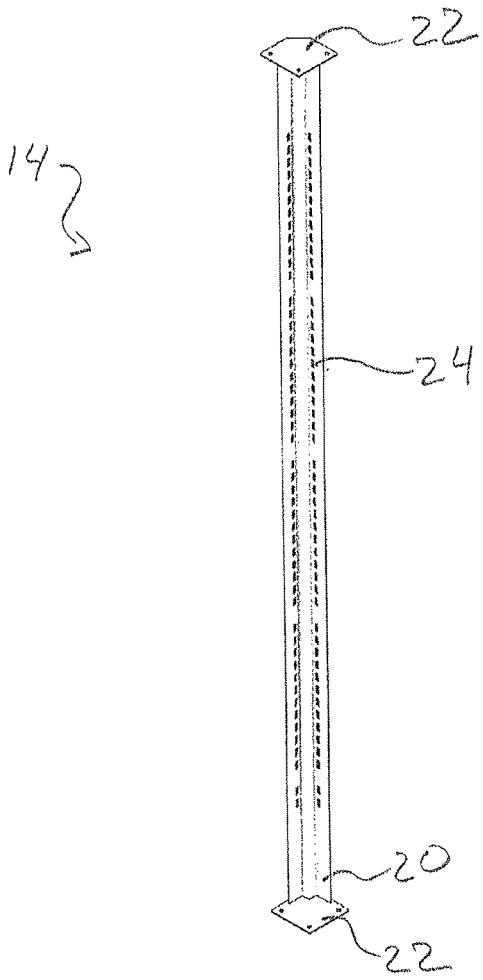
FIG. 2 is a perspective view of a notched channel assembly.

Referring now to FIG. 2, each support 14 includes a column 20 that extends vertically from the base 12 to the header 16. The column 20 has a generally W-shaped cross section when viewed from above. The W shape provides a useful balance of strength and torsional rigidity without excessive weight. Other shapes may be used. The supports 14 include a foot portion 22 at each distal end of the W-shaped column 20 for attachment to base mount 12B and the header assembly 16. The foot portions 22 may be attached to the column 20 by a weld, by using a chemical adhesive, by forming the foot portions 22 and the column 20 as a single unitary piece, or by other similar means of attachment. In turn, the foot portions 22 of the supports 14 are attached to the base mount 12B and the header 16 of the display 10, preferably using fasteners such as screws or nails, although chemical adhesive and other known means of attachment are also contemplated.

Additionally, the column 20 defines multiple elongate slots 24 for receiving cooperating latch pieces attached to the shelf units 18 that support the shelves. The slots 24 and/or cooperating pieces may have a keyed shape if desired for increased holding power. While the display 10 shown in FIG. 1A uses four supports 14, it will be appreciated that fewer or more supports may be used without deviating from the scope of this invention. Indeed, in some applications it may be useful to configure a three-sided, five-sided, six-sided or other-dimensioned display unit of the invention.

Figure 3:
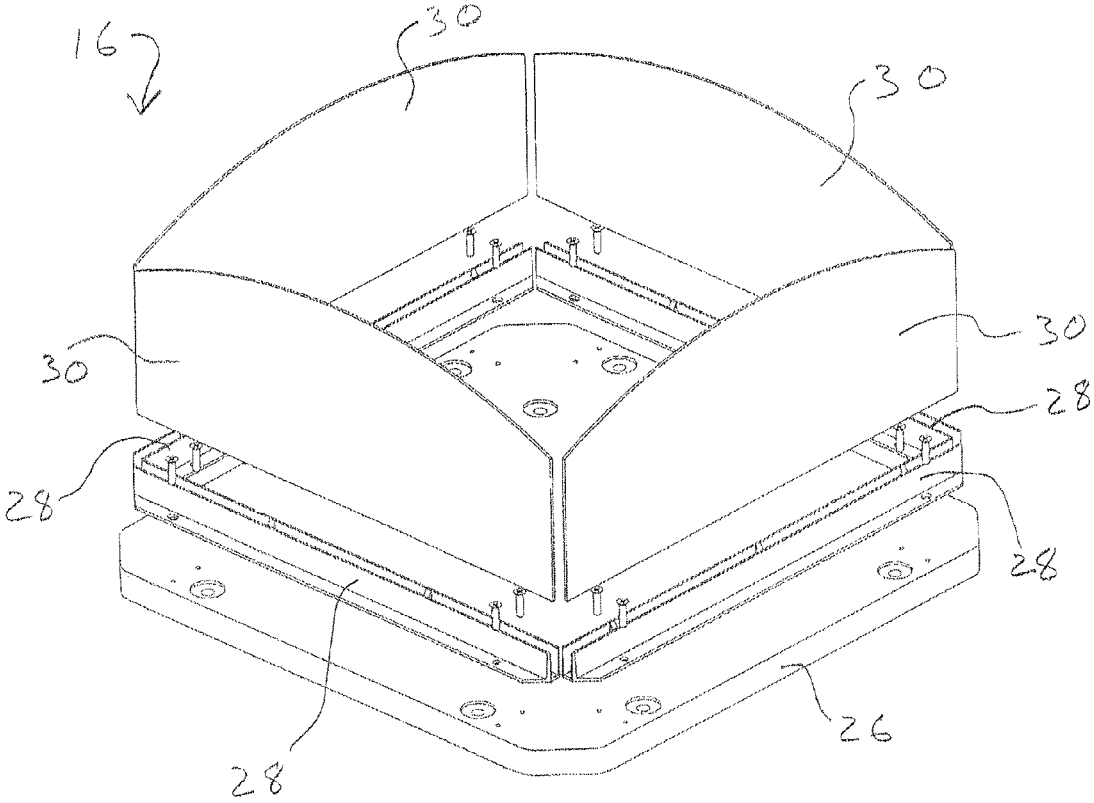
FIG. 3 is an exploded view of a header assembly.

FIG. 3 illustrates the example header assembly 16 in detail. Attached to a top axial end of the vertical supports 14 (not illustrated in FIG. 3) is a header assembly 16. The header 16 includes a base 26 and one or more holding pieces 28. The holding pieces 28 are generally elongate and positioned along the edges of the base 26 between supports 14. The base 26 is attached to each of the vertical supports 14 to provide structural support and stability. As shown in FIG. 3, multiple holding pieces 28 are attached to the base 26 using fasteners such as screws, tacks, nails, or the like. Alternatively, the holding pieces 28 could be attached to the base 26 by an adhesive, or other known means of affixation. Each holding piece 28 is configured to removably hold a sign, light or other element. The example holding pieces 28 illustrated generally define a channel which is configured to receive and retain, for example, printed signs 30 or the like. Signs 30 may be illuminated, carry digital messages, or include other features as desired. Alternatively, signs 30 may be replaced with any number of desirable elements—the holding pieces 28 may be configured to retain lights attached to a stem for illuminating the shelves 18 below or for illuminating a sign above, electric display signs, or other relatively small and light objects in addition to or in place of the signs 30. Moreover, while the header assembly 16 shown in FIG. 3 includes four holding pieces 28, it will be appreciated by those of skill in the art that more or fewer fixtures could be used without departing from the scope of the invention. Likewise, many alternate header assemblies 16 are possible.

Figure 4A:
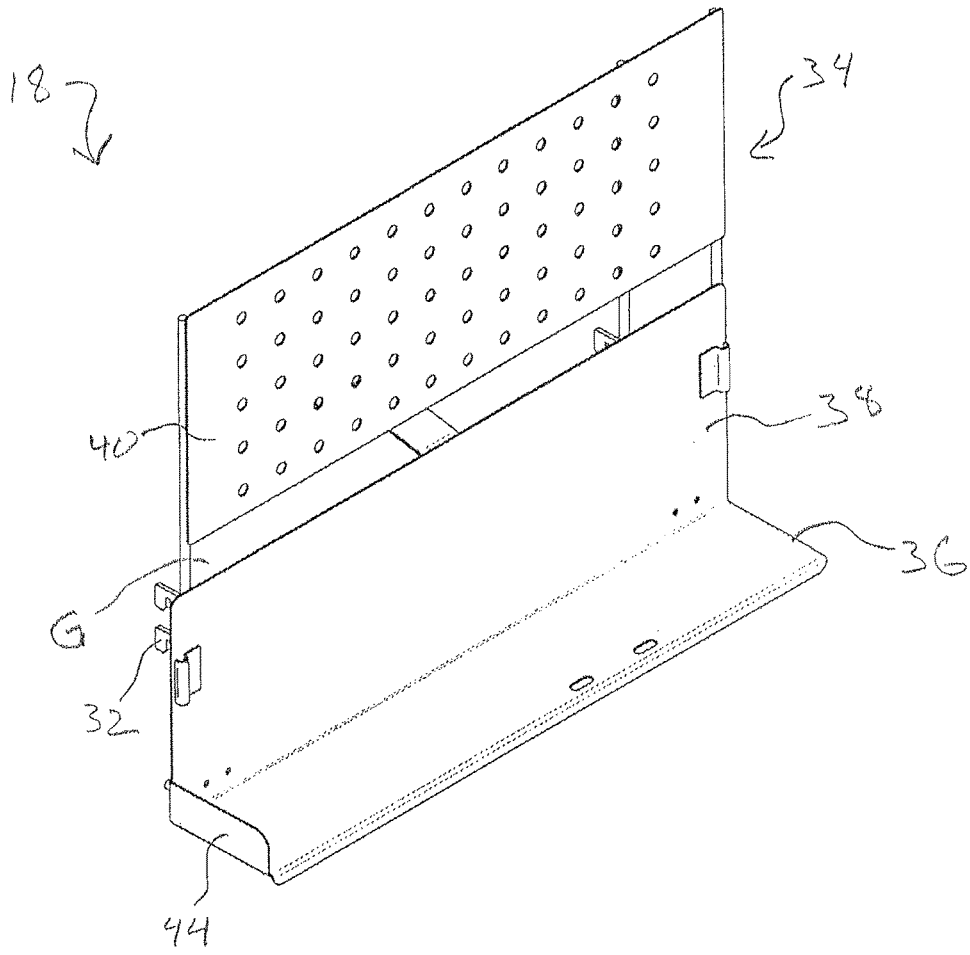
FIG. 4A is a perspective view of a shelf of the display unit.
Figure 4B:
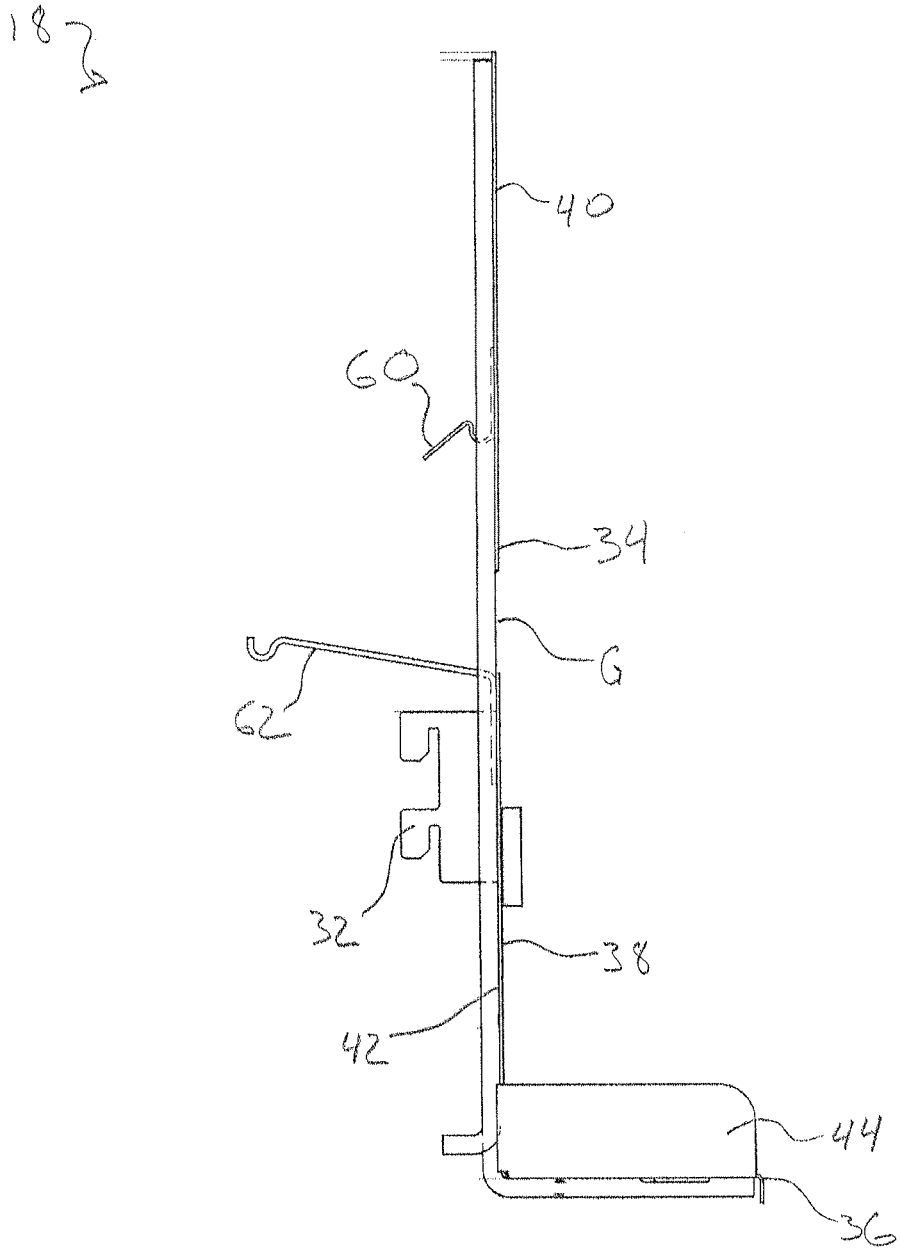
FIG. 4B is a side elevation of the shelf of FIG. 3A.

FIGS. 4A and B provide two views of an example shelf unit 18. The shelf units 18 of the display 10 are configured to be adjustably and removably attached to the vertical supports 14 using knife brackets 32, which may be inserted into desired slots 24 on the supports. The shelf units 18 and the supports 14 thus define vertical sides of the display 10. As shown in FIG. 4A, the shelf unit 18 includes a vertical portion 34, a horizontal floor 36, and a hinged portion 38. The vertical portion 34 includes a substantially planar upper plate 40 that, when installed on the display 10, describes a plane that is oriented substantially vertical. The upper plate 40 preferably defines a plurality of perforations arranged in a grid pattern, with an example being a peg board configuration. As shown in FIG. 4B, the vertical portion 34 also includes a lower plate 42 arranged to be substantially co-planar with the upper plate 40, and separated from the upper plate to define a gap G between upper and lower plates.

The horizontal floor 36 is a generally planar, relatively shallow plate that is arranged perpendicular to the vertical portion 34. In addition, the horizontal floor 36 includes a vertical side wall 44 arranged to be perpendicular to both the horizontal floor 36 and the vertical portion 34. The horizontal floor 36 together with cooperating elements is configured to support and display relatively flat and thin 2-D merchandise (e.g., wall calendars), although other configurations will be suitable for other articles.

Figure 6:
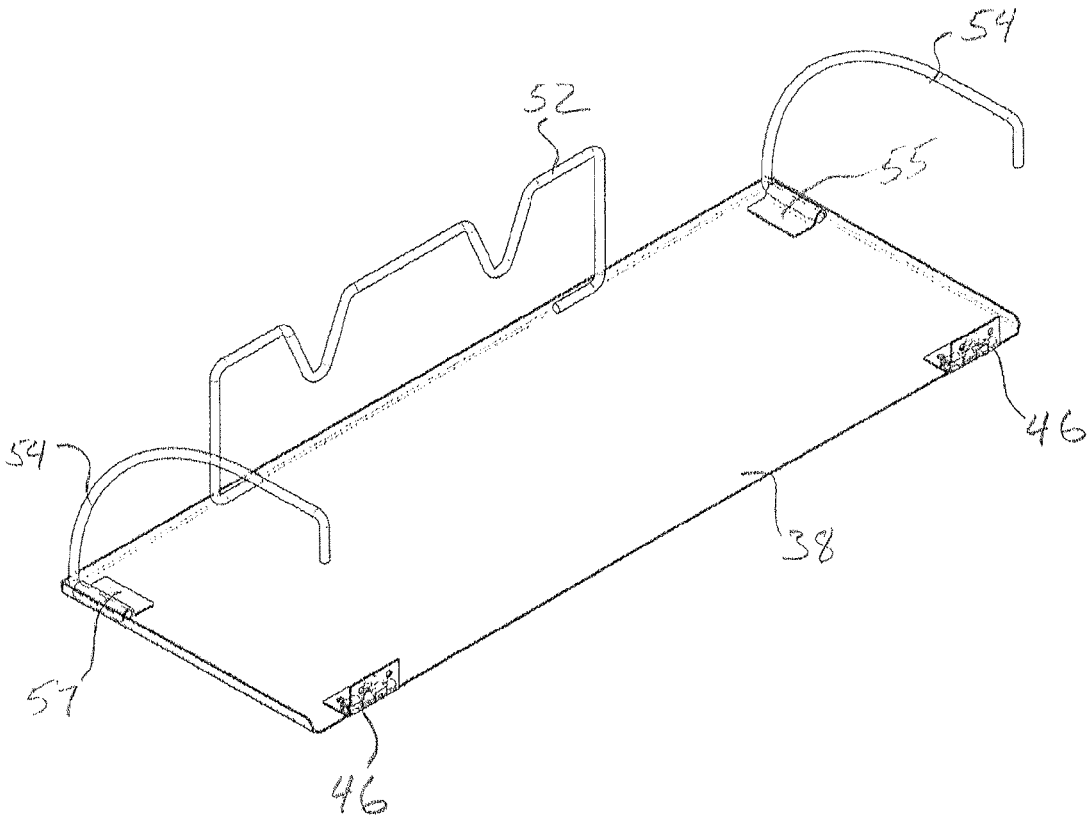
FIG. 6 is a rear perspective view of a hinged floor assembly used in the display unit of FIG. 1B.

The hinged portion 38 is relatively planar and is hingedly attached to the vertical portion 34 using one or more barrel or other hinges 46, as best illustrated in FIG. 6. Referring again to FIG. 3A, the hinged portion 38 is movable between a storage position that is substantially parallel with the vertical portion 34 and a display position that is substantially parallel with the horizontal floor 36.

Figure 5A:
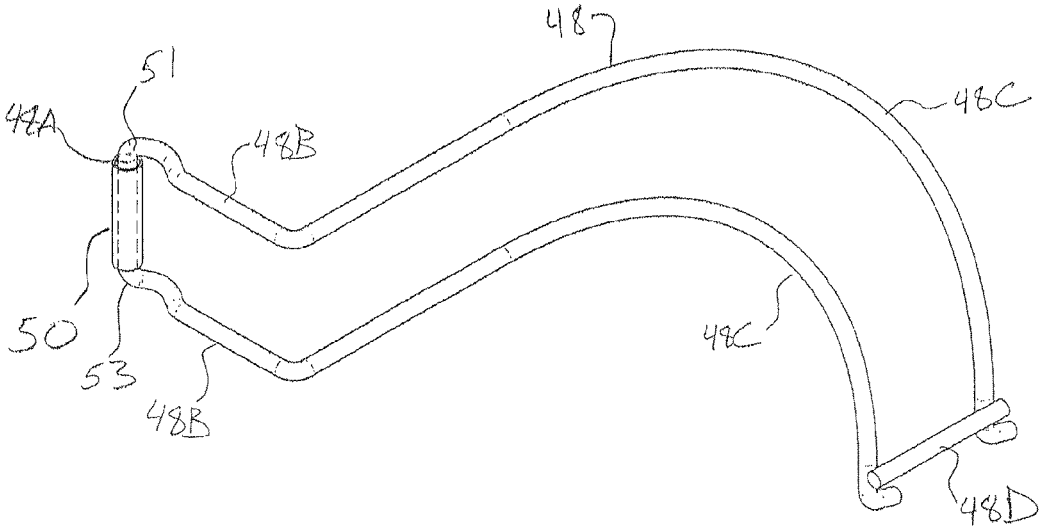
FIG. 5A is a perspective view of a first fence used in the display unit of FIG. 1A.

Referring to FIG. 5A, a first fence 48 is attached to the shelf unit 18 by a tubular pivot mount 50 attached to the vertical portion 34. This allows the first fence 48 to pivot about the plane described by the vertical portion 34. The first fence 48 may be shaped as desired to hold variously shaped articles. The illustrated first fence is defined by a plurality of differently shaped legs, including a mounting leg 48A, pairs of straight legs 48B, pairs of arcuate legs 48C, and a joining leg 48D that connects ends of the arcuate legs 48C. The legs are connected to one another as illustrated, and generally arranged in a parallel manner to hold articles of a particular shape.

First fence mounting leg 48A is received by the pivot mount 50. The pivot mount 50 may be, for example, a plastic or metal sleeve that surrounds the cooperating fence mounting leg 48A and allows for rotational movement thereof. It may be sized to allow for a desirable degree of friction. It may also be sized in a vertical direction so that it engages the fence 48 between two fence shoulders 51 and 53 at ends of the straight legs 48B to prevent vertical slippage. The first fence 48 preferably rotates approximately 270° between a display position and a storage position. Alternatively, it is contemplated that the fence may rotate more or less, depending on the number of vertical sides included in the display 10.

Figure 5B:
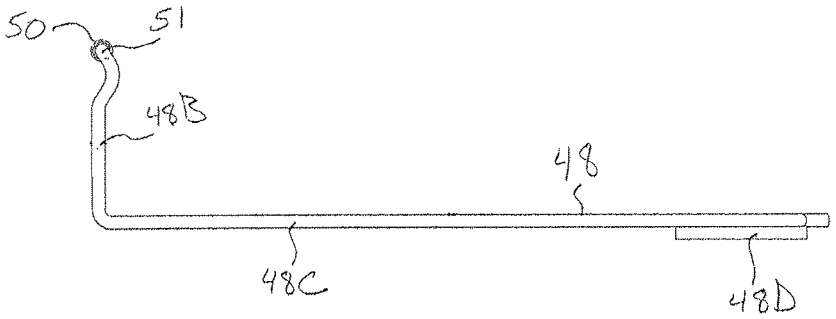
FIG. 5B is an overhead plan view of the first fence of claim 5A.

When in the display position, the first fence 48 may be releasably received a locking member, such as a detent, cavity, or through-hole described by the horizontal floor 36. As shown in FIG. 5A, the arcuate legs 48C, when the first fence 48 is in a display position as shown in FIG. 1A, are configured to help retain merchandise on the horizontal floor 36. The first fence 48, when in the display position, extends along a first side edge and a front edge of the shelf unit 18, leaving a second side edge of the horizontal floor unobstructed. Moreover, as shown in FIG. 5B, the first fence 48 has a generally L-shaped profile when viewed from above. While the first fence 48 is preferably made from metal wire, alternative materials such as molded plastic polymers, are also contemplated. Also, many other shapes for the first fence 48 may be provided as desired for holding of differently shaped articles. Indeed, an advantage of invention embodiments includes the ability to customize as desired to hold differently shaped articles.

FIG. 1A shows the display unit 10 in a first "in-season" configuration, such that the first fence is in the display position and the hinged portion is in the storage position. As discussed previously, this configuration is well suited for 2-D merchandise that is relatively flat, such as wall calendars, magazines, etc. Other configurations can be provided for other articles.

To place the display unit 10 in a second configuration as shown in FIG. 1B, the first fence 48 is rotated from the display position to the storage position by rotating the first fence about the pivot 50. The storage position is within a display unit 10 interior (described below), and in this position the fence 48 is conveniently hidden from sight. Then, the hinged portion 38 is moved from the storage position to the display position. As shown in FIG. 6, the hinged portion 38 includes a front fence 52 positioned at a front edge of the hinged portion, and one or more side fences 54 positioned at side edges of the hinged portion. The front fence 52 helps to hold articles in place when being displayed. The front fence 52 may be a metal wire fence as shown in FIG. 6, however, artisans will appreciate the fence shape and material may be changed without departing from the scope of the invention, with alternate example shapes and materials widely available for use as the front fence 52. Front fence 52 is preferably fixed so that it extends perpendicular to the surface of the hinged portion 38. Alternatively, the front fence 52 may be pivotably mounted on the hinged portion 38, such that the front fence may be pivoted into an operative position that is substantially perpendicular to the hinged portion. Side fences 54 are hingedly attached to the hinged portion 38, and can be moved to an operative position by rotating the fences so that they are perpendicular to the hinged portion, and are releasably retained.

Side fences 54 may be pivotably attached through use of cooperating receiving brackets 55 that receive a receiving end 57 of the generally arcuate side fence 54. The brackets 55 may be shaped to provide a suitable degree of friction to hold the side fences 54 in place but allow for some movement.

The hinged portion 38 is relatively deep in comparison to the horizontal floor 36. Accordingly, the hinged portion 38 is useful for displaying thicker, 3-D merchandise as compared to the floor 36. FIG. 1B shows the display unit 10 with the shelf units 18 configured in the second configuration with hinged portion 38 in a display position.

Referring now to FIG. 1C, the display unit 10 can be arranged in a third "peg board" configuration by placing both the first fence 48 and the hinged portion 38 in their respective storage positions. This allows for placement of standard retail hooks into the perforated upper plate 40 of the vertical portion 34. Such a configuration is useful for displaying hanging merchandise.

Figure 7:
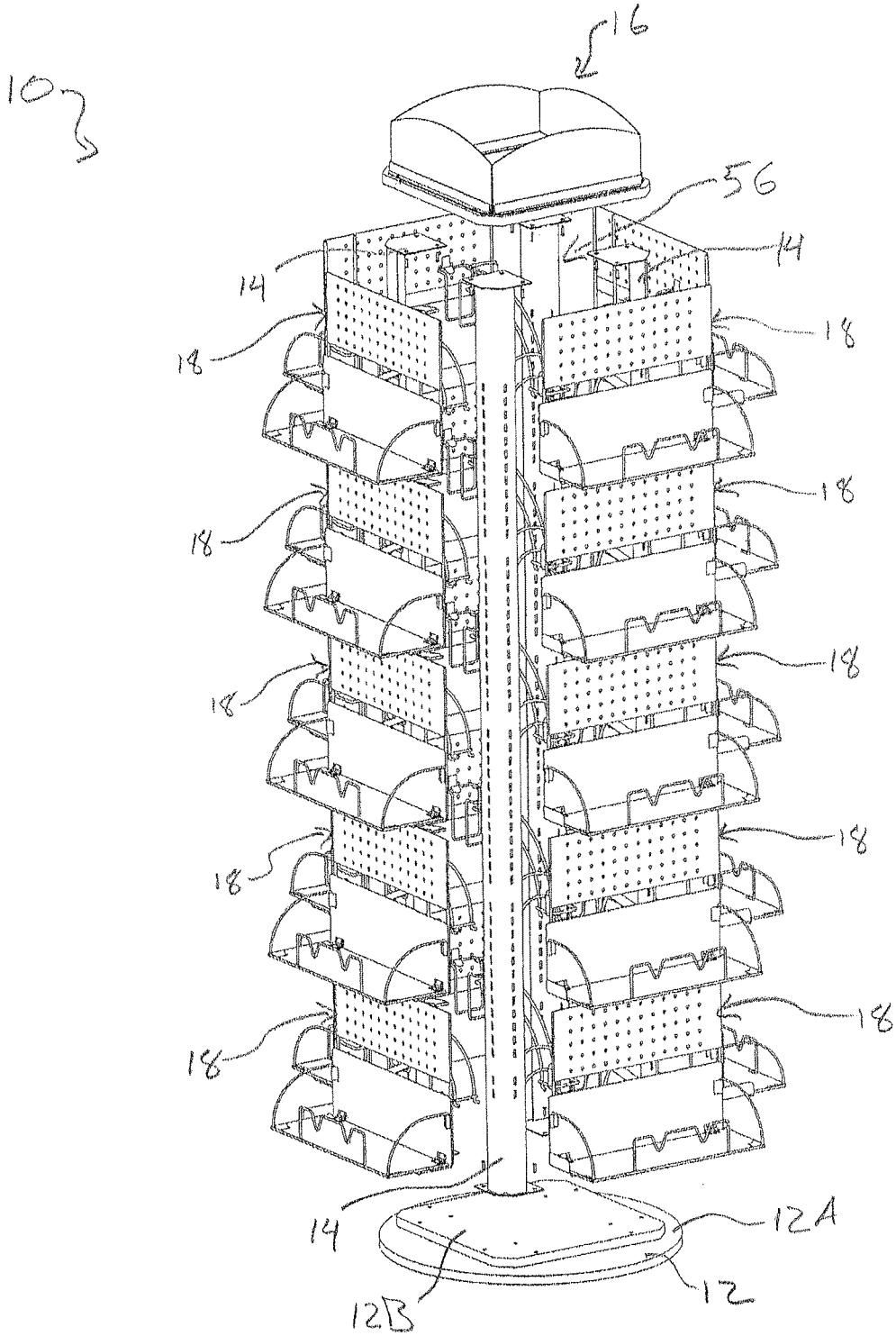
FIG. 7 is an exploded perspective view of the display unit of FIG. 1B, showing a portion of the inner central storage area.

As best shown in FIG. 7, the display unit 10 surrounds an inner central section 56. When the first fence 48 is in the storage position, the fence has been pivoted into and is held in the inner central section 56. In this position, the first fence 48 is releasably retained by spring clip 60 (shown in FIG. 3B). Similarly, when the hinged portion 38 is in the storage position, front fence 52 protrudes through the gap G in the vertical potion 34 of the shelf unit 18 and into the inner central portion 56, and is releasably retained by spring clip 62. Spring clips 60 and 62 may take a variety of different shapes or configurations, and be made of metal, plastic or other material. They generally include a first end attached to the vertical portion 34, and a second distal end protruding into the central section 56 for springingly and releasably engaging the fence 48/hinged portion 38. The spring configurations illustrated have proven useful. Other storage can be provided within central section 56, including other shelving components, merchandise inventory, and other articles as may be desirable. This provides useful advantages.

Example embodiments of the display unit 10 of the present invention achieve important advantages and benefits over conventional displays in at least areas of cost, space, and time savings. Because the display unit 10 is configurable into a plurality of different display modes, a retailer receives the benefit of three or more display types for displaying differently sized articles. Additionally, the example display unit 10 is designed so that it can be used year round. It has the capability to display different sized products using different shelves during different seasons without having the need to design, purchase, store, or use multiple different displays or shelves. This saves the user time and money because he or she is not purchasing and storing different displays for every one of their new products. He or she simply configures the shelf units 18 of the present display unit 10 in a way that will best fit the specific product.

Moreover, the display unit 10 has a relatively small foot print. Further, it does not require removal of pieces and corresponding additional storage space when converting to different configurations. It does not have the inconvenience of requiring the user to store loose components, which are used in one season and removed in another. Instead, shelves have all of their components for different configurations pivotally attached and stored in the display unit.

It is quick and easy to change the shelf configuration of the display unit 10. In one example embodiment, it takes no more than approximately 10 minutes to change all 20 shelf units 18 to any selected configuration. This is achieved, at least in part, by the pivoting adjustment of shelves, fences and other elements between storage and display positions. This is a significant savings over the prior art. With the quick adjustment of shelf configuration using the display unit 10, a retailer has the opportunity to efficiently merchandise a greater multitude of products, and they are not restricted by a fixed design. The retailer need not spend time looking for new displays for each season, and may display the merchandise immediately, without waiting for the arrival of a display that better suits the desired merchandise. No skilled labor is required for changing configurations providing for further convenience and cost savings.

Figure 8:
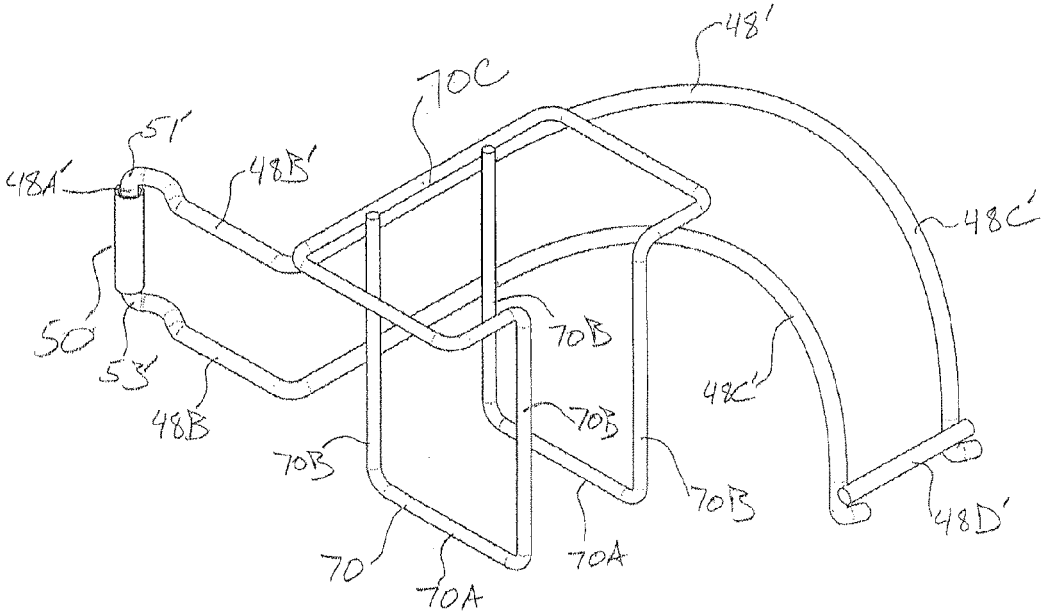
FIG. 8 is a perspective view of an alternative first fence for use in the display unit of FIG. 1A.

The novel aspects of the display 10 further allow for a high degree of customization. As an example, a wide variety of rotating fences can be provided to accommodate holding many differently sized articles. FIG. 8, for example, illustrates an alternate first fence 48'. This fence 48' is generally similar to the fence 48, but additionally has been provided with holding cage 70. Cage 70 is shaped to hold articles of a particular shape, and is attached to fence 48' by use of an adhesive, welding, thermoforming, or the like. Cage 70 includes a pair of floor legs 70A, two pair of vertical side legs 70B, and a top rim 70C. The various legs define a cage interior which can hold articles such as a cube shaped product, a liquid or pill container, or the like. Further, a walled plastic container can be placed into the cage 70 that includes a floor and closed sides so that a plurality or multiplicity of small articles can be held therein. As an example, hardware fasteners such as screws or nails, candy, marbles, or other small articles can be contained. Although cage 70 has been illustrated as connected to the fence 48' permanently, it may be removably attached using one or more clips, clamps or the like if desired. Attachments such as cage 70 add to the versatility and customizable nature of the display of the invention. These example cages 70 are illustrated installed on the display 10 in FIG. 1A (not numbered in the drawing, however).

Figure 9:
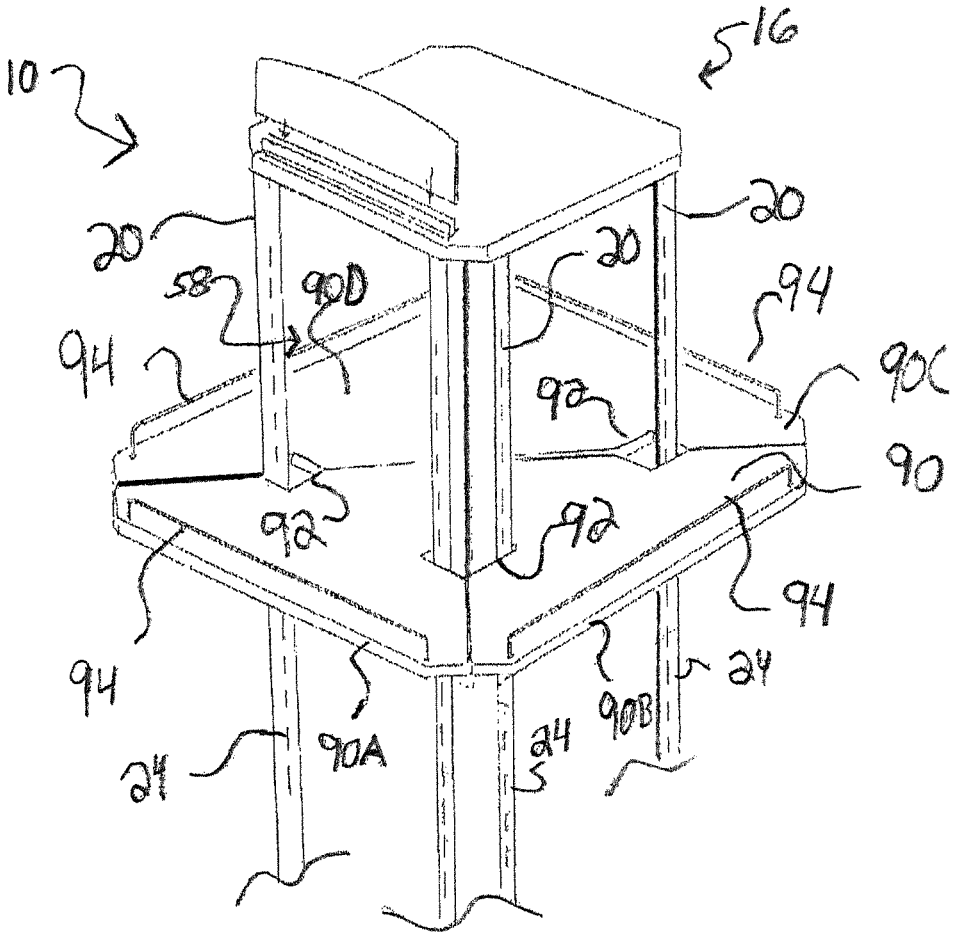
FIG. 9 is a perspective view of another shelf embodiment for use with the display unit.

It will be appreciated that although example embodiments of display units of the invention have been shown and discussed, many alternatives are within the scope of the invention. For example, the example display is made using a variety of metal and wooden parts. Other embodiments may feature some or all components made of other materials to achieve weight and/or cost savings, with examples including plastics and other polymers. Also, many different height and width dimensions could be used. Changes can be made to the spinner so that it is not so tall. As an example, the height could be scaled down to 2, 3 or 4-layers high from the illustrated 5-layers (consequently down to 16 shelves or some other number from current 20 shelves). This would make the assembled unit to appear more compact, lighter, and easier to spin. This would also improve visibility within the store area. Many other numbers of shelves can be used, including greater layers/numbers. Applications will dictate which is preferred. In each of these variations, a central inner portion is defined between the sidewalls. The product determines the size of the unit. The bigger the merchandise is, the larger the footprint of the display must be to accommodate the merchandise FIG. 9 illustrates still another example shelf embodiment. A generally planar shelf 90 includes passages 92 for receiving the display support columns 20 therethrough and extends across the inner portion 58. Shelf 90 can be used in combination with others of the shelves described herein above to provide further display and storage capability, or can be used alone (with one or more used). Wire fences 94 are located about the perimeter of the planar shelf 90. Shelf 90 is held in place by placing locking pins into column slots 24 below the desired position of shelf 90, with the locking pin engaging a bottom side of the shelf 90. Locking pins are of standard configuration and need not be illustrated herein. The shelf 90 illustrated has been provided in four general triangle shaped portions 90A, B, C and D for ease of installation. The triangle shaped portions 90A-D can be joined to one another using fasteners on their top, bottom or side edges, or may be independently supported. In other embodiments, shelf 90 could be provided as a single piece, which would necessitate installation before header 16 was attached to columns 20. Shelf 90 allows for display and storage of larger items, for example, than other shelves described herein. A riser, such as a generally cube shaped element, can be supported on the center of the shelf 90 to provide an elevated display area for some goods within the inner portion 56 of the display 10.

Figure 10:
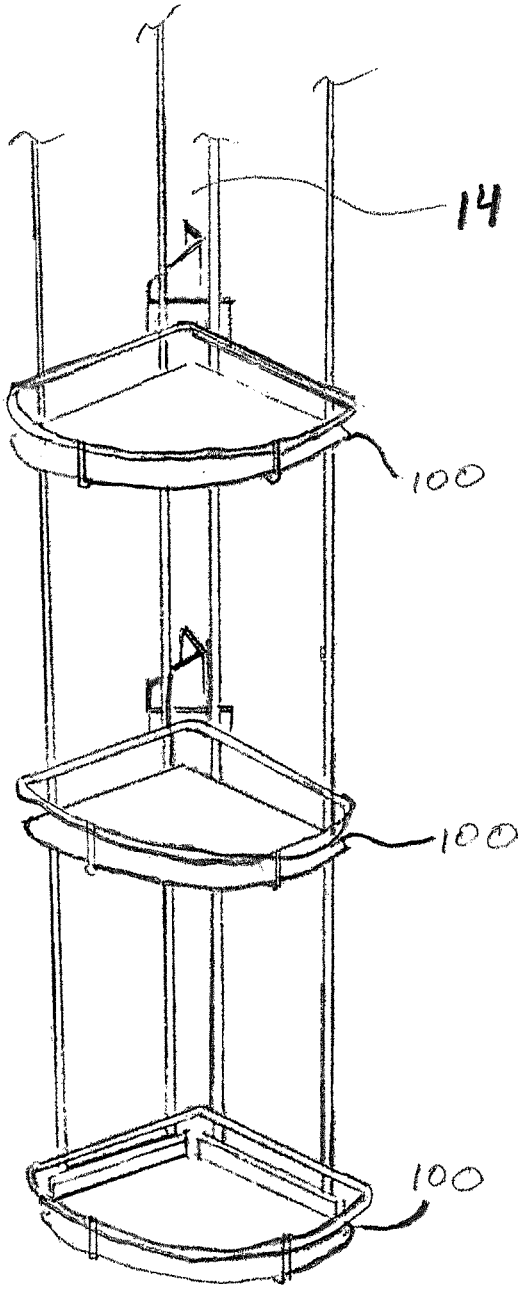
FIG. 10 is a perspective view of an example of an additional shelf that can be added to the display unit.

In addition to the shelves illustrated and discussed, almost an infinite number of additional shelf configurations can be provided. These include, but are not limited to, hanging basket shelves 100 made of a wire frame or plastic material supported at the corners of the display 10 close to the columns 20, as shown in FIG. 10. The shelves 100 may be generally triangular, having two straight sides and an arcuate side as shown in FIG. 10 for attachment about the corners of the display to columns 20. Alternatively, the shelves can take the general shape of a cup and include a mounting bracket for engaging one or more column slots 24 for mounting. Other shelves can be provided with peg attachments for engaging display peg board portions 40 (FIG. 4A) in a variety of shapes and configurations. Again, different of such shelves can be used in combination or alone to provide a highly customizable display. When not in use, these shelves can be stored in the display inner portion 58 if desired.

Figure 11:
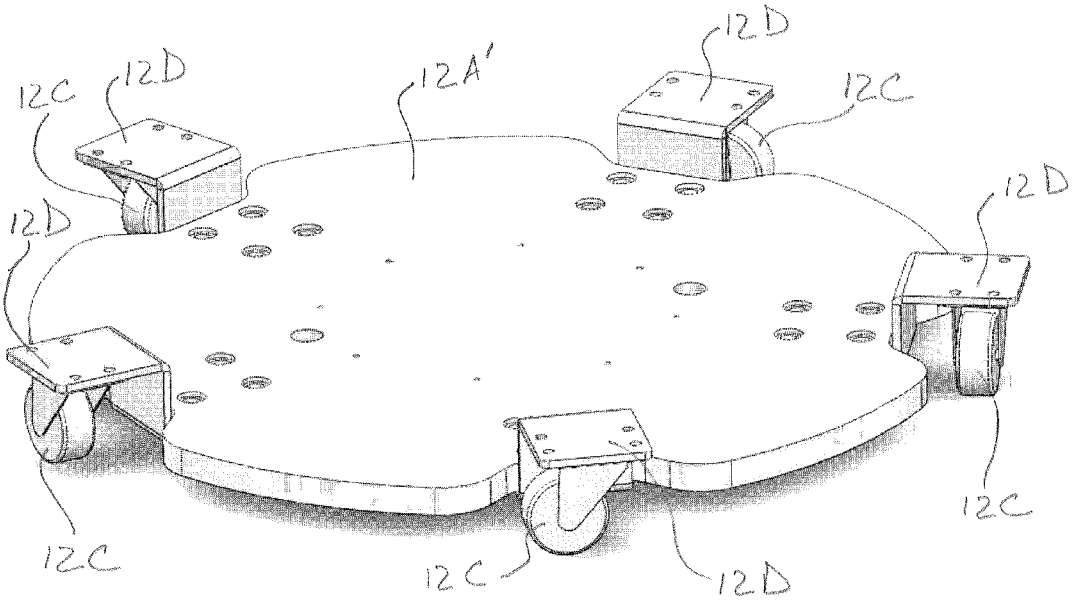
FIG. 11 is a perspective view showing an alternative structure for one portion of the display unit base that includes casters.

As another example of the configuration options available, in some applications an easily movable display 10 may be desirable. For such applications wheels can be provided on the display base. In FIG. 11 shows an alternative embodiment of the circular portion 12A' of the base 12 including casters 12C. The alternate circular portion 12A' includes multiple cutouts configured to house the casters 12C. While the example circular portion 12A' includes 5 casters 12C, it will be appreciated that more or fewer casters could be included. The casters 12C are preferably attached to the circular portion 12A' via recessed mounting brackets 12D as shown in FIG. 11. This advantageously provides the portability benefits of casters, without substantially increasing the overall height of the display unit 10. That is, the mounting brackets 12D are recessed such a bottom edge of the circular portion 12A' is relatively close to the floor to provide aesthetic and stability benefits. For example, when using casters 12C having a height of 3 inches, the mounting brackets 12D may be recessed approximately 2.75 inches into the base circular portion 12A', so that instead of raising the overall height of the display 10 by 3 inches the circular portion 12A' bottom edge sits approximately 0.25 inches from the floor and the overall height of the display is increased by only 0.25 inches.

Alternatively, the casters 12C could be mounted directly to the circular portion 12A' or via other known mounting mechanisms. The casters 12C optionally include wheel locks that prevent the wheels of the casters 12C from spinning. Additionally, the casters 12C may be either fixed such that the orientation of the casters does not change relative to the display unit 10, or free such that the casters are permitted to pivot about an axis perpendicular to the circular portion 12A'. A square mount may be rotatably attached to the circular portion 12A' as described above, or the vertical supports 14 may be attached directly to the circular portion without the intervening mount.

Although example embodiments have been discussed and illustrated that utilize a rotating base, other embodiments do not. Further, some invention embodiments include only some aspects of the interchangeable shelves discussed above used on supports other than a display. One example is a non-rotating wall of a store or other location. Many other combinations and variations of invention embodiment elements are possible. The scope of the present invention is not limited by any single embodiment described or discussed herein, nor by the particular elements illustrated. Many alternative combinations and equivalent elements will be apparent to those knowledgeable in the art, and are within the scope of the invention.

The invention claimed is:

1. A free standing display unit comprising:

a rotating base;

a plurality of vertical supports mounted on the base; and a plurality of shelves supported by the a plurality of vertical supports, an interior central portion of the display enclosed by the plurality of shelves, wherein each shelf is interchangeable between a plurality of different configurations, with a first configuration changeable to a second configuration by pivoting movement of one or more components of the shelf between a stored position and an operational position, wherein each of the shelves includes a vertical back wall and a fence that rotates about a vertical axis at one end of the vertical back wall, said fence being movable between the stored and operational positions, and wherein each fence is rotatably mounted along one end of a respective vertical back wall, such that each fence rotates about 270° between the operational position wherein it is removably locked to a horizontal shelf floor and the stored position within the interior central portion of the display unit.

2. A display unit as claimed in claim 1, the display unit further comprising:

a plurality of vertical sides defined by the plurality of shelves, the plurality of shelves arranged on each side; and the display unit defining the interior central portion between the plurality of vertical sides.

3. The display unit as claimed in claim 2, wherein the plurality of shelves are a plurality of first shelves, and further comprising a generally planar second shelf including at least one passage for receiving the at least one vertical support, the second shelf extending across the inner central portion.

4. A display unit as claimed in claim 1, wherein the shelves are configured to display generally flat objects having a size of at least about 9 inches by 9 inches in the first configuration, and configured to display objects having a greater thickness in the second configuration.

5. A display unit as claimed in claim 1, wherein the first configuration defines an "In-season" configuration, the second configuration defines an "Off-season" configuration, and the shelves are further interchangeable to a third "peg board" configuration.

6. A display unit as claimed in claim 1, wherein each of the plurality of shelves includes a mounting portion having a plurality of receiving cavities, and a plurality of clips for mounting in the cavities.

7. A display unit as defined by claim 1, wherein the fence includes a mounting leg located between two shoulders that engage a cooperating tubular mounting pivot to allow pivoting rotation between the stored and operational positions.

8. A display unit as defined by claim 7, wherein the fence further includes a plurality of additional legs, including at least a pair of generally parallel arcuate legs.

9. A free standing display unit comprising:

a rotating base;

a plurality of vertical supports mounted on the base; and a plurality of shelves supported by the a plurality of vertical supports, an interior central portion of the display enclosed by the plurality of shelves, wherein each shelf is interchangeable between a plurality of different configurations, with a first configuration changeable to a second configuration by pivoting movement of one or more components of the shelf between a stored position and an operational position.

wherein each of the shelves includes a vertical back wall and a fence that rotates about a vertical axis at one end of the vertical back wall, said fence being movable between the stored position within the interior central portion of the display unit and operational positions, and the wherein each of the plurality of shelves includes a horizontal floor and, and wherein each fence is rotatably mounted along one end of the back wall, a respective vertical fence having a locking end that is removably engageable with each shelf horizontal floor.

10. A display unit as claimed in claim 9, further comprising vertical mounting shoulder wall that are extending from the shelf horizontal floor.

11. A display unit as claimed in claim 9, wherein each of the plurality of shelves has the first configuration that includes the first horizontal shelf floor, and the different second configuration that includes a different second horizontal shelf floor, the second horizontal shelf floor pivoting approximately 90° to a vertical storage position when the shelf is placed in the first configuration.

12. A display unit as claimed in claim 11, wherein the second configuration includes shelf end pieces that are pivoted about 90° into storage positions along the plane of the second shelf floor when the shelf is in the storage position.

* * * * *